US011641924B2

(12) United States Patent
Yan

(10) Patent No.: US 11,641,924 B2
(45) Date of Patent: May 9, 2023

(54) DUAL-ENDED STICK MECHANISM

(71) Applicant: ELC Management LLC, Melville, NY (US)

(72) Inventor: Jian Yan, Kirkland (CA)

(73) Assignee: ELC Management LLC, Melville, NY (US)

( * ) Notice: Subject to any disclaimer, the term of this patent is extended or adjusted under 35 U.S.C. 154(b) by 444 days.

(21) Appl. No.: 17/081,314

(22) Filed: Oct. 27, 2020

(65) Prior Publication Data

US 2022/0125180 A1 Apr. 28, 2022

(51) Int. Cl.

| | |
|---|---|
| ***A45D 40/24*** | (2006.01) |
| ***B65D 85/72*** | (2006.01) |
| ***A45D 40/06*** | (2006.01) |
| *A45D 40/00* | (2006.01) |

(52) U.S. Cl.

CPC ..... *A45D 40/065* (2013.01); *A45D 40/24* (2013.01); *A45D 2040/0025* (2013.01)

(58) Field of Classification Search

CPC ..... A45D 40/06; A45D 40/065; A45D 40/24; A45D 2040/0025

USPC ..... 206/385; 132/318; 401/27, 29, 30, 34, 401/56, 78, 85, 89, 112

See application file for complete search history.

(56) References Cited

U.S. PATENT DOCUMENTS

| | | | | |
|---|---|---|---|---|
| 2,710,614 A * | 6/1955 | Dulberg | A45D 40/24 | 206/385 |
| 3,438,714 A | 4/1969 | Seaver | | |
| 4,750,501 A * | 6/1988 | Ackermann | A45D 40/06 | 401/78 |
| 5,040,914 A | 8/1991 | Fitjer | | |
| 5,186,560 A * | 2/1993 | Holloway | A45D 40/06 | 401/78 |
| 5,306,107 A | 4/1994 | Kageyama et al. | | |
| 5,899,620 A * | 5/1999 | Pierpont | A45D 40/06 | 401/78 |
| 6,412,999 B1 * | 7/2002 | Pierpont | A45D 40/12 | 401/74 |
| 8,444,334 B2 | 5/2013 | Cardia | | |
| 8,647,004 B2 * | 2/2014 | Chan | A45D 40/06 | 401/78 |
| 9,004,795 B2 * | 4/2015 | Salciarini | A45D 40/10 | 401/109 |

(Continued)

FOREIGN PATENT DOCUMENTS

| | | |
|---|---|---|
| DE | 202005007550 U1 | 9/2005 |
| FR | 2869206 A1 | 10/2005 |
| KR | 101594319 B1 | 2/2016 |

OTHER PUBLICATIONS

PCT International Search Report; International Application No. PCT/US2021/056520; Completion Date: Feb. 16, 2022; dated Feb. 16, 2022; 20.11.

(Continued)

*Primary Examiner* — Luan K Bui

(74) *Attorney, Agent, or Firm* — Peter Giancana

(57) ABSTRACT

A dual-ended stick mechanism comprises a dual-ended holder cup that holds two stick products; a single inner body with longitudinal shaft; a single cam sleeve a with helical groove; two A-shell members; and two overcaps. When either overcap is rotated with respect to the opposite A-shell, the holder cup moves up and down. A register feature alerts the user that the holder cup has reached its neutral position.

12 Claims, 15 Drawing Sheets

(56) References Cited

U.S. PATENT DOCUMENTS

| | | | | |
|---|---|---|---|---|
| 10,154,720 | B2 | 12/2018 | Yeung et al. | |
| 2003/0068187 | A1* | 4/2003 | Holloway | A45D 40/12<br>401/78 |
| 2008/0166172 | A1 | 7/2008 | Eng et al. | |
| 2015/0055997 | A1* | 2/2015 | Holloway | A45D 40/04<br>401/31 |

OTHER PUBLICATIONS

PCT Written Opinion of the International Searching Authority; International Application No. PCT/US2021/056520; Completion Date: Feb. 16, 2022; dated Feb. 16, 2022; 20.11.

Taiwan IPO Search Report from TW Application No. 110139679; dated Apr. 11, 2022; 20.11.

Taiwan IPO Search Report from TW Application No. 110139679; dated Oct. 20, 2022; 20.11.

* cited by examiner

DUAL-ENDED STICK MECHANISM

FIELD OF THE INVENTION

The present invention relates to a container for housing two consumer products, such as cosmetics, in stick form. More particularly, it relates to a dual-ended mechanism that allows one or the other stick product to be moved between an advanced position, where the stick product is able to be applied by a consumer, and a retracted position for storing the product between uses.

BACKGROUND

Prior art containers for stick products may include a cylinder that has a rotatable member disposed at its bottom end. The stick product is received into a holder cup, and the holder cup is disposed within the cylinder. Rotation of the rotatable member relative to the cylinder causes a mechanism inside the cylinder to advance the stick product longitudinally away from the rotating member such that a portion of the stick product becomes exposed above the cylinder. In this manner, the exposed portion of the product is available for application.

For example, a common type of container features a base that is permanently connected to a cylindrical inner body, and a cam sleeve placed around the inner body, such that the cam sleeve and body can rotate with respect to each other. The inner body is hollow, and has a wall with at least one longitudinal slot that extends through the wall. The cam sleeve has an inner wall that features at least one helical groove that extends along a substantial length of the inner wall. A product holder cup is provided with at least one cam follower in the form of a lug. When the holder cup is fitted into the inner body, the lug extends through the longitudinal slot of the inner body to engage the helical groove of the cam sleeve. When the base is and cam sleeve are rotated relative to each other, the helical groove applies pressure to the lug of the holder cup, which drives the holder cup up or down in the longitudinal slot, thereby moving the stick product between an advanced and a retracted position. A typical example of this type of device is described in U.S. Pat. No. 3,438,714. Such devices work well, but are limited to offering only one stick product.

Expellant devices that have two stick products emerging from either end of the device are known. See, for example, US2008-0166172, U.S. Pat. Nos. 8,444,334 and 5,306,107. None of these has the simplicity of the device described herein. For example, U.S. Pat. No. 8,444,334 utilizes two cam sleeves between which the lugs of the holder cup must pass, and this requires a precise alignment that can be difficult to achieve.

OBJECT OF THE INVENTION

A main object of the invention is to provide a dual-ended mechanism, of relatively simple design, that is able to extend and retract two stick products, and that is airtight when not in use.

SUMMARY

A dual-ended stick mechanism according to the present invention comprises a dual-ended holder cup (1) that holds two stick products (9, 9'), one at each end; a single inner body (2) with longitudinal shaft; a single cam sleeve (3) with helical groove; two A-shell members (4, 4'); and two overcaps (5, 5'). Each overcap forms an airtight seal on its respective A-shell. In use, a user presses on the top of the first overcap to disengage it from the rest of the mechanism. The second overcap is not removed, and maintains contact with the inner body such that the second overcap and inner body will rotate together. Thus, when the second overcap and cam sleeve are rotated with respect to each other, the holder cup advances in the inner body and moves the stick product to an extended position where it can be used. The opposite rotation causes the holder cup to retract. A register feature alerts the user that the holder cup has reached its neutral position.

DETAILED DESCRIPTION

The term "comprises" and its variants means that a list of elements is not necessarily limited to those explicitly recited. The following description refers to the opposing ends of several members as "top" and "bottom," but the designations are for reference only, as either end could be taken as the top or bottom.

Figure 1:
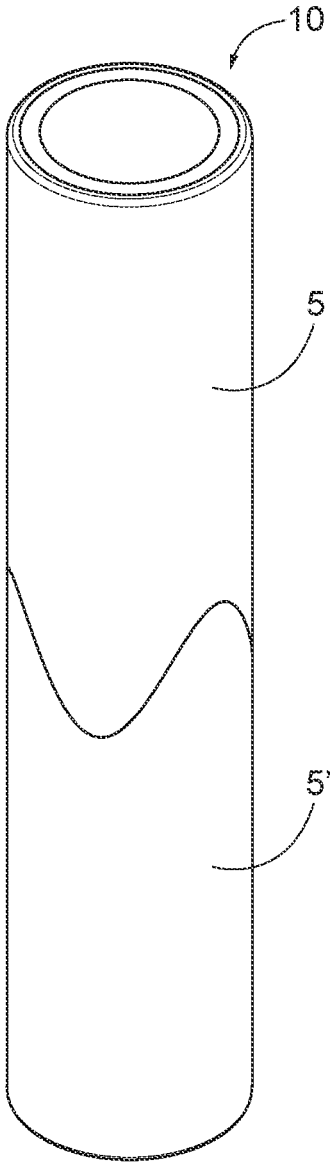
FIG. 1 depicts a dual-ended stick mechanism according to the present invention, in a closed configuration.
Figure 2:
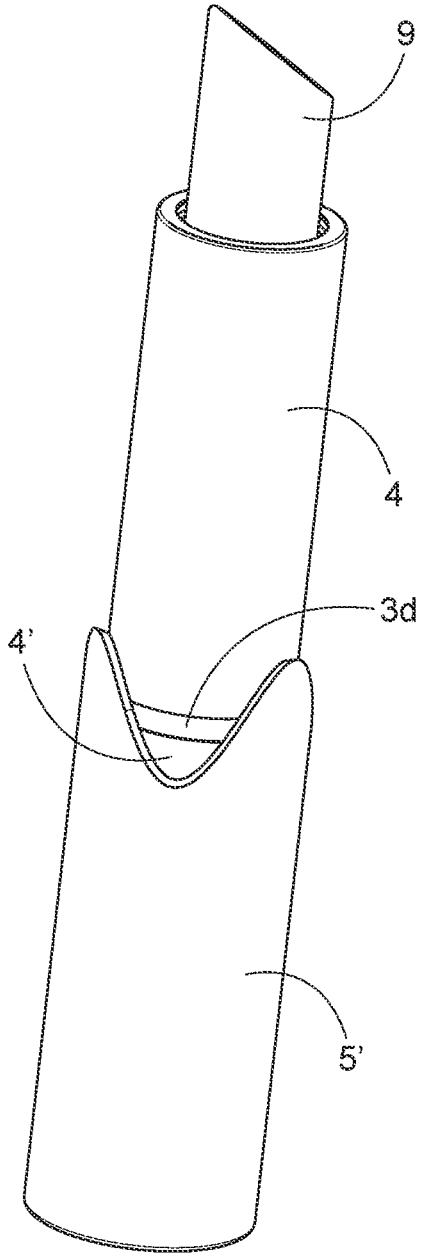
FIG. 2 depicts the dual-ended stick mechanism of FIG. 1, with one of the overcaps removed.

A dual-ended stick mechanism according to the present invention comprises a dual-ended holder cup (1), a single inner body (2), a single cam sleeve (3), two A-shell members (4, 4'), and two overcaps (5, 5'). FIG. 1 depicts one embodiment of a dual-ended stick mechanism (10) according to the present invention, in a fully closed configuration. Overall, the mechanism is cylindrical and enclosed within the two overcaps (5, 5'). FIG. 2 depicts the dual-ended stick mechanism of FIG. 1, with one of the overcaps (5) removed and one stick product extended. If the other overcap (5') had been removed instead, the mechanism would present exactly the same way.

One Dual-Ended Holder Cup (1)

Figure 3:
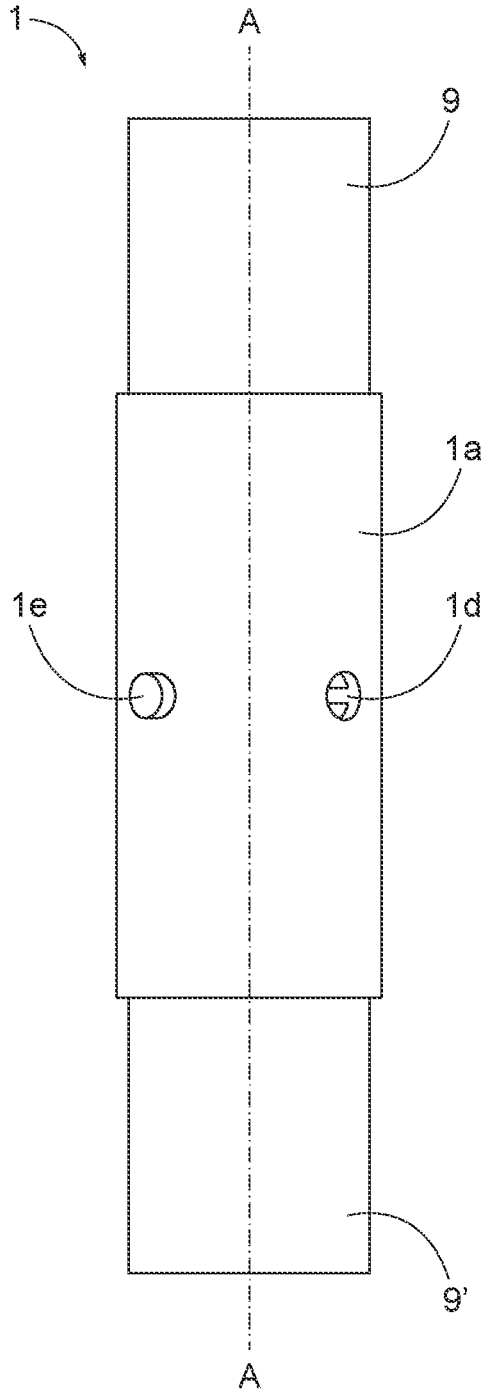
FIG. 3 is an isometric view of a dual-ended holder cup with two stick products contained therein.
Figure 4:
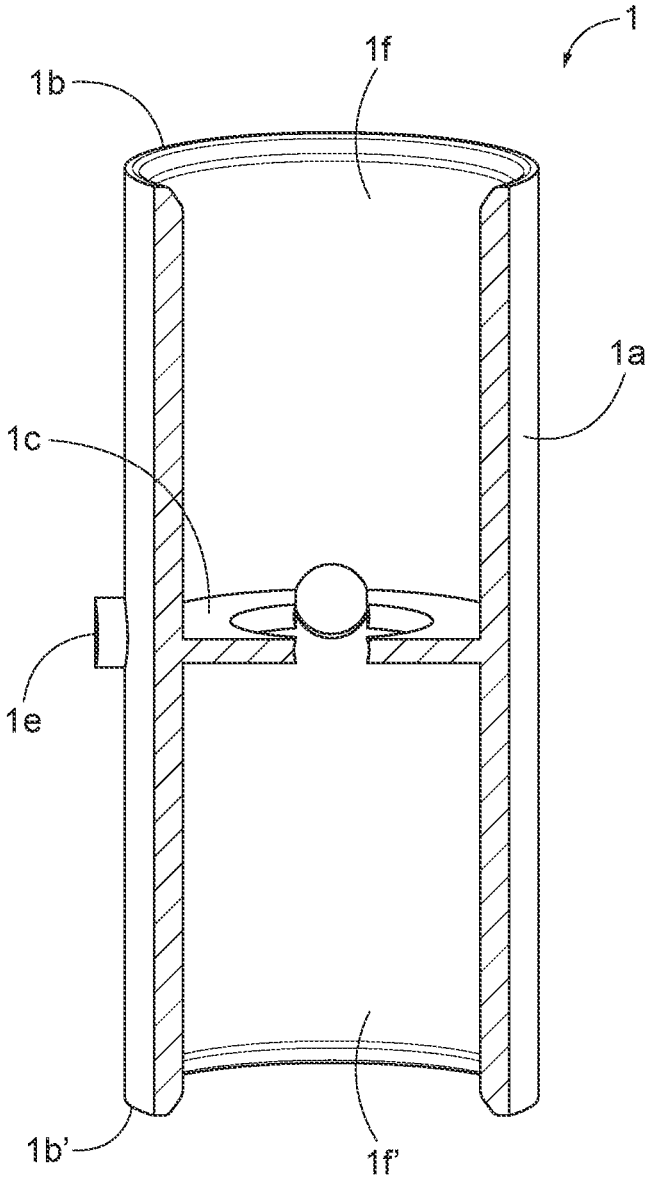
FIG. 4 is a sectional view of the holder cup of FIG. 3.

A dual-ended holder cup (1) according to the present invention is depicted in FIGS. 3 and 4. The holder cup holds two stick products that extend from the holder cup in opposite directions, along a central longitudinal axis, A. The holder cup comprises a cylindrical wall (1*a*) with an opened top end (1*b*) and an opened bottom end (1*b*'). The interior of the holder cup acts as a reservoir. The reservoir may be divided across the center by a partition (1*c*) into an upper reservoir (1*f*) and a lower reservoir (1*f*'). Each reservoir is able to receive and retain a portion of a solid or semi solid stick product, such as a lipstick, lip balm, deodorant stick, anti-perspirant stick, glue stick, etc. Each stick is generally retained in the holder cup by friction or by an undercut design, but additional means may be provided as known in the art. One or more vent holes (1*d*) that pass through the cylindrical wall may be positioned at about the level of the partition to allow air to escape as the stick products (9, 9') are being inserted into the holder cup through the open ends. A single lug (1*e*) is located half way up the cylindrical wall. The lug has a length that extends perpendicularly from the cylindrical wall. When the mechanism is fully assembled, the holder cup will travel within the inner body, and the lug will travel along the upper and lower segments (2*e*, 2*e*') of the longitudinal track and in the upper and lower horizontal tracks (2*c*, 2*c*') of the inner body (2) (see below). The length of the lug (1*e*) is long enough to extend through and beyond the longitudinal and horizontal tracks of the inner body.

One Inner Body (2)

Figure 5:
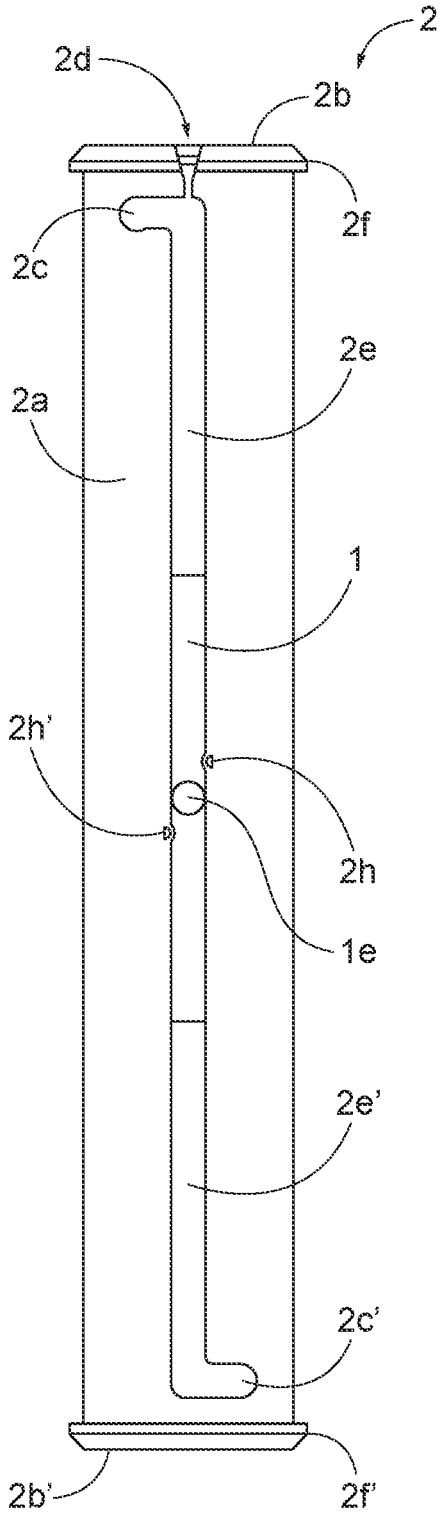
FIG. 5 is an elevation view of an inner body with a dual ended holder cup therein.

Referring to FIG. 5, the inner body (2) comprises a generally cylindrical side wall (2*a*) that has an opened top (2*b*) and an opened bottom (2*b*'). A longitudinal track, and upper and lower horizontal tracks that extend from the longitudinal track, pass through the sidewall. The longitudinal track is comprised of an upper segment (2*e*) and a lower segment (2*e*'). These two segments are co-linear and meet in the middle of the side wall of the inner body. The upper segment extends between this meeting point and the upper horizontal track (2*c*). The lower segment extends between this meeting point and the lower horizontal track (2*c*').

Preferably, at least one of the horizontal tracks (for example, the upper horizontal track) intersects with a notch (2*d*) that opens up onto the opened top (2*b*) or opened bottom (2*b*') of the inner body. The notch provides the side wall (2*a*) with some flexibility, such that the opening at the top (2*b*) of the inner body can be temporarily enlarged, and then allowed to return to its original size. In this way, the holder cup (1) can be inserted into the inner body by forcing the lug (1*e*) through the notch (2*d*) and into the upper segment (2*e*) of the longitudinal track. Since only one such notch is needed, it is preferable if the lower horizontal track (2*c*') does not open up onto the bottom of the inner body. When the mechanism is fully assembled, the lug (1*e*) will travel along the upper and lower segments (2*e*, 2*e*') of the longitudinal track and in the upper and lower horizontal tracks (2*c*, 2*c*') of the inner body (2).

When the holder cup (2) is positioned in the middle of the inner body, we say that it is in its neutral position. In neutral position, neither stick product (9, 9') is extended beyond the inner body. When the mechanism (10) is not in use, the holder cup will, in general, be at its neutral position. However, when the holder cup is being retracted from an extended position, it is possible to retract the holder cup too far, and overshoot the neutral position, such that the unseen stick product (9', for example) might mash into the inside of the overcap (5'). To help a user avoid this occurrence, two or more bumps (2*h*, 2*h*') may be located a short distance above and below the midpoint of the longitudinal track, near the meeting point of the upper and lower segments (2*e*, 2*e*') of the longitudinal track. These bumps project slightly into the upper and lower segments, and are spaced apart longitudinally to allow the lug (1*e*) of the holder cup (1) to fit in between the them (see FIG. 5). As the holder cup moves up and down in the inner body, the bumps provide a slight resistance to the movement of the holder cup, as the lug is forced over each bump. As a user retracts the holder cup into the inner body, the sensation will let the user know when the lug is located in between the bumps (that is, when the holder cup has reached neutral position), and that she should stop retracting the holder cup.

Preferably, both the top (2*b*) and bottom (2*b*') of the inner body (2) are formed with a rim (upper rim 2*f*, lower rim 2*f*) that overhangs the side wall (2*a*) of the inner body. The purpose of the rims will be explained below.

Figure 10:
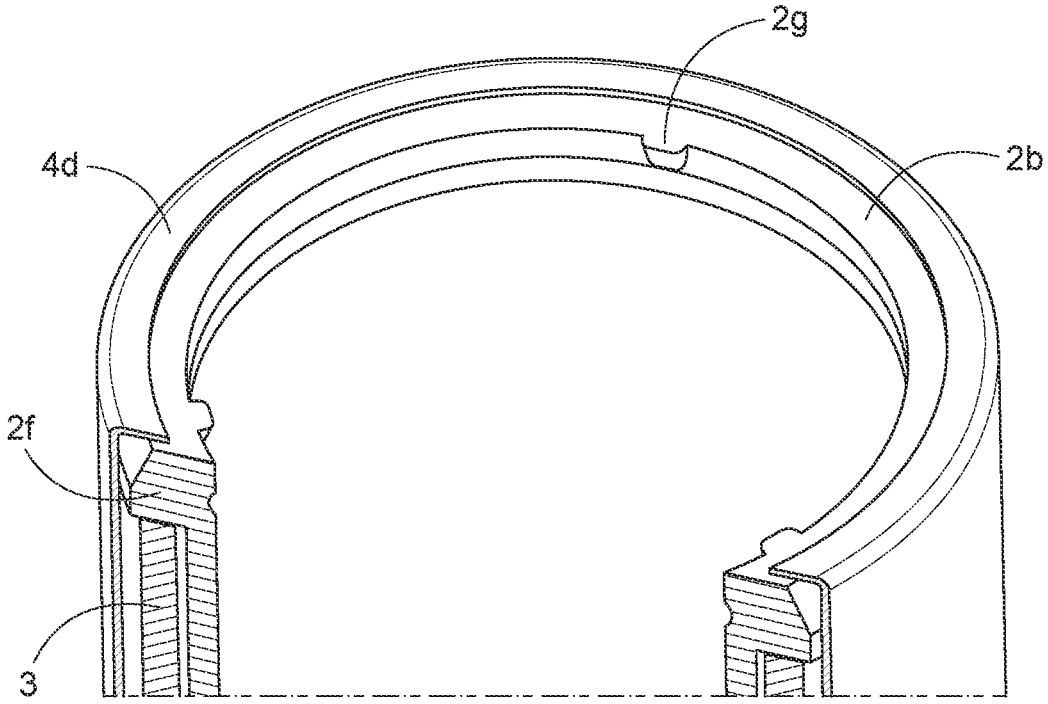
FIG. 10 is a sectional view that shows the relationship between the inner body, cam sleeve and A-shell.

Referring to FIG. 10, a first set of teeth (2*g*) project inward (into the space enclosed by the cylindrical side wall, 2*a*) from the opened top (2*b*) of the inner body. Preferably, at least three teeth are equally spaced around the perimeter of the opened top. For example, three such teeth may be spaced 120° apart, or four such teeth may be spaced 90° apart, along the perimeter of the opened top. The second set of teeth (not shown in the drawings) is located along the perimeter of the opened bottom (2*b*') of the inner body. The purpose of the teeth will be explained below.

One Cam Sleeve (3)

Figure 6:
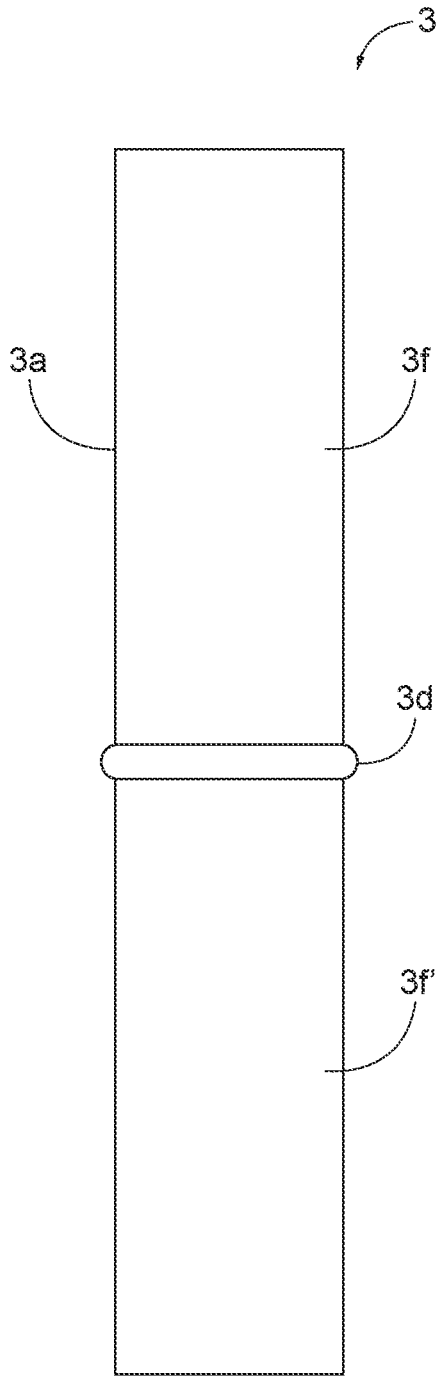
FIG. 6 is an elevation view of a cam sleeve.
Figure 7:
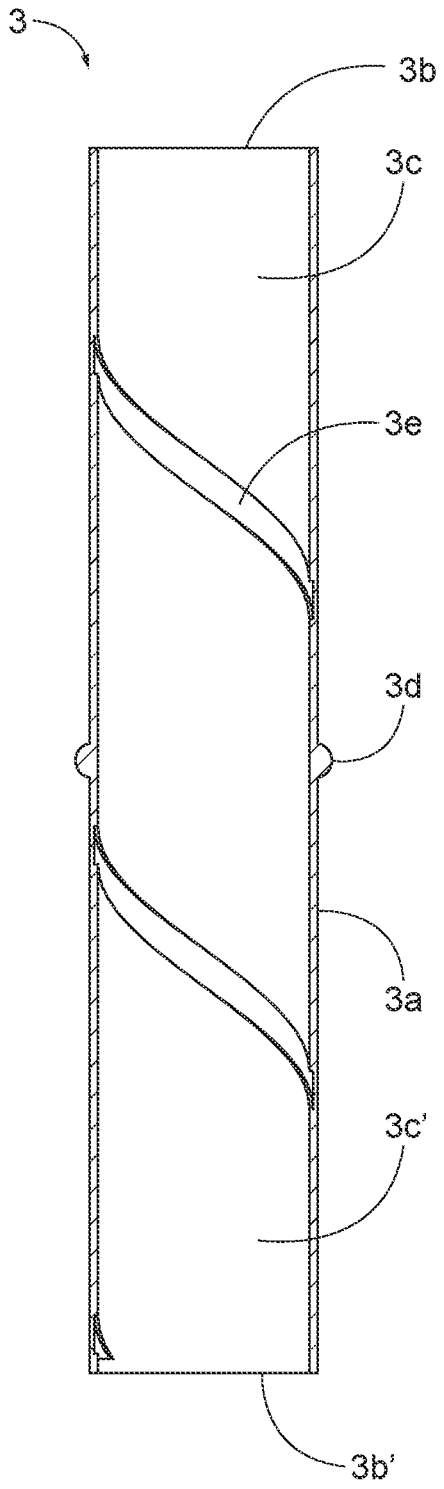
FIG. 7 is a cross sectional view of the cam sleeve of FIG. 6.

A dual-ended stick mechanism (10) according to the present invention has only one cam sleeve. A cam sleeve (3) is shown in FIGS. 6 and 7. The cam sleeve comprises a generally cylindrical hollow body (3*a*) with an exterior surface and an interior surface that houses the inner body (2). The hollow body is unitary, but may be considered as comprising a hollow upper body (3*f*) with an opened top (3*b*) and an upper interior surface (3*c*), and a hollow lower body (3*f*) with an opened bottom (3*b*') and a lower interior surface (3*c*'). The cam sleeve is designed slide over the inner body (2) in a concentric fashion. The upper and lower interior surfaces are provided with a helical groove (3*e*). The helical groove starts near the top (3*b*) of the hollow upper body (3*f*), and completes some number of revolutions, or fraction thereof, to end near the bottom (3*b*') of the hollow lower body (3*f*). Typically, the number of revolutions and fraction thereof will be between 1 and 3; such as 1, 1¼, 1½, 1¾, 2, 2¼, 2½, 2¾ or 3 revolutions, or any other fraction between about 1 and 3 revolutions. Preferably, the pitch of the helical groove is constant, and the same number of revolutions and fractions thereof are located on the upper and lower interior surfaces. This will provide a user with a consistent experience when using either side of the dual-ended mechanism.

The cam sleeve (3) is mounted to the outside of the inner body (2) by inserting the top (2*b*) of the inner body (the end with the notch (2*d*)) into the opened bottom (3*b*') of the cam sleeve. The notch will allow the side wall (2*a*) of the inner body to compress enough to allow the cam sleeve to slip onto the inner body. When fully seated on the inner body, the cam sleeve and inner body are concentric, and the cam sleeve is trapped between the upper and lower rims (2*f*, 2*f*) that overhang the side wall (2*a*) of the inner body. The cam sleeve will substantially fill that space, so that very little vertical movement of the cam sleeve with respect to the inner body is possible, however, the cam sleeve and inner body can rotate with respect to one another. The cam sleeve fits over the inner body (2) in such a way that distal end of the lug (1*e*) of the holder cup (1), which passes through the longitudinal track of the inner body, will be located in the helical groove (3*e*) of the cam sleeve. The exterior surface of the cam sleeve may comprise an annular stop (3*d*) located at the midpoint of the cam sleeve, between the hollow upper body (3*f*) and the hollow lower body (3*f'*). The annular stop is one-half of a locking feature that secures each overcap (5, 5') on the dual-ended mechanism (10). The full operation of the locking feature will be described below.

Two A-Shell Members (4, 4')

Figure 8:
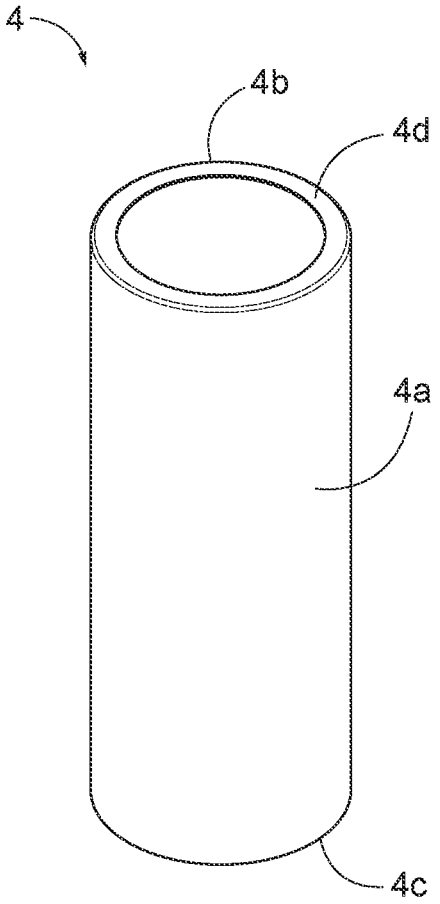
FIG. 8 depicts one of two identical A-shells.
Figure 9:
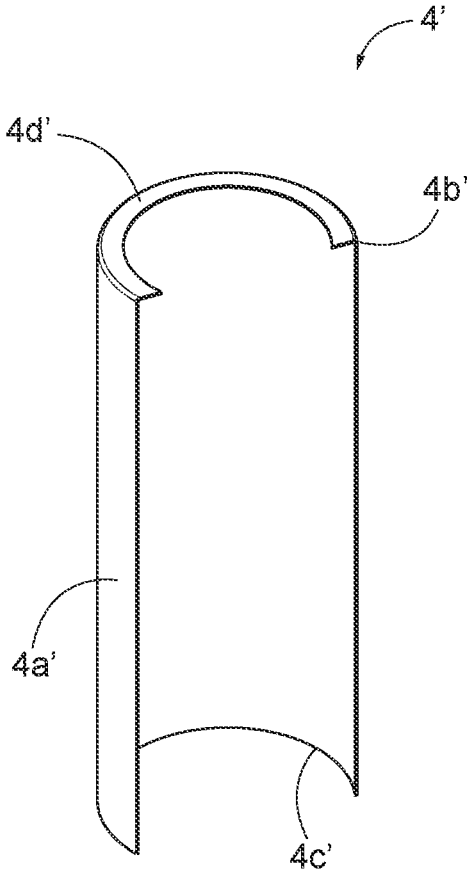
FIG. 9 is a cross section of the second of two identical A-shells.

A dual-ended stick mechanism (10) according to the present invention comprises two identical A-shells (4, 4'). Referring to FIGS. 8 and 9, each A-shell comprises a cylindrical side wall (4*a*, 4*a'*), an opened upper end (4*b*, 4*b'*), and an opened lower end (4*c*, 4*c'*). For each A-shell, a flange (4*d*, 4*d'*) may extend inwardly, at the upper opened end (4*b*, 4*b'*).

The opened lower end (4*c*) of one A-shell (4) fits snugly over the hollow upper body (3*f*) of the cam sleeve (3), and the opened lower end (4*c'*) of the other A-shell (4') fits snugly over the hollow lower body (3*f*) of the cam sleeve. The A-shells and cam sleeve rotate as one. That is, if either A-shell is rotated, then the cam sleeve will also rotate. For example, the fit of the A-ells on the cam sleeve may be sufficiently tight to prevent relative rotation between either A-shell and the cam sleeve. Optionally, adhesive may be used between the A-shells and the cam sleeve.

As noted above, when fully seated on the inner body (2), the cam sleeve (3) is trapped between the upper and lower rims (2*f*, 2*f*) that overhang the side wall (2*a*) of the inner body. In other words, the upper and lower rims extend beyond the ends of the cam sleeve. Therefore, when each A-shell is fully positioned on the cam sleeve, the flanges (4*d*, 4*d'*) will rest just above the upper and lower rims (2*f*, 2*f*) of the inner body (see FIG. 10).

The A-shells also serve an aesthetic purpose, as decorative covers for the cam sleeve. The A-shells may be made of plastic, but a more upscale appearance may be achieved with metal A-shells. Also, the A-shells are sized such that the opened lower ends (4*c*, 4*c'*) of the A-shells will bottom out on the annular stop (3*d*) of the cam sleeve (as seen in FIG. 2). However, the annular stop of the cam sleeve extends transversely beyond the A-shells.

Two Overcaps (5, 5')

Figure 11:
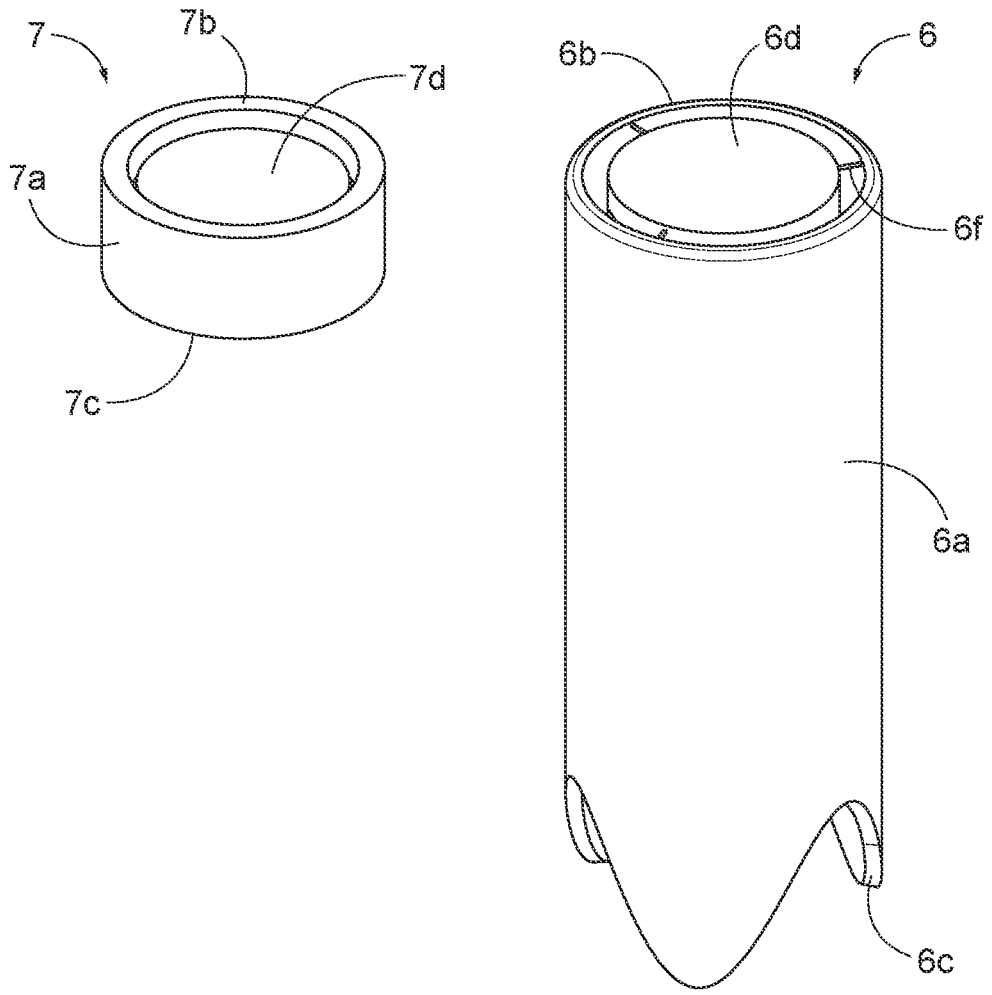
FIG. 11 is a perspective view of the overshell and inner cap.
Figure 12:
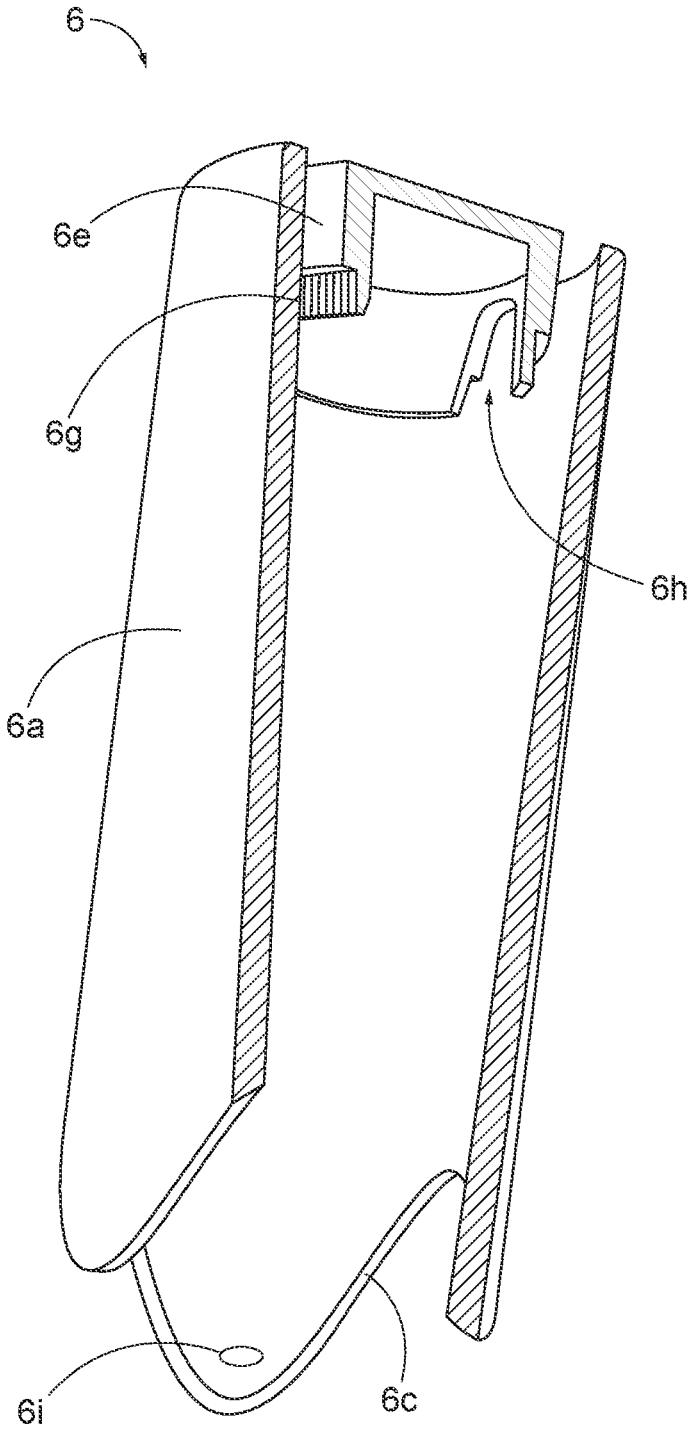
FIG. 12 is a cut-away view to show the interior of the overshell.
Figure 13:
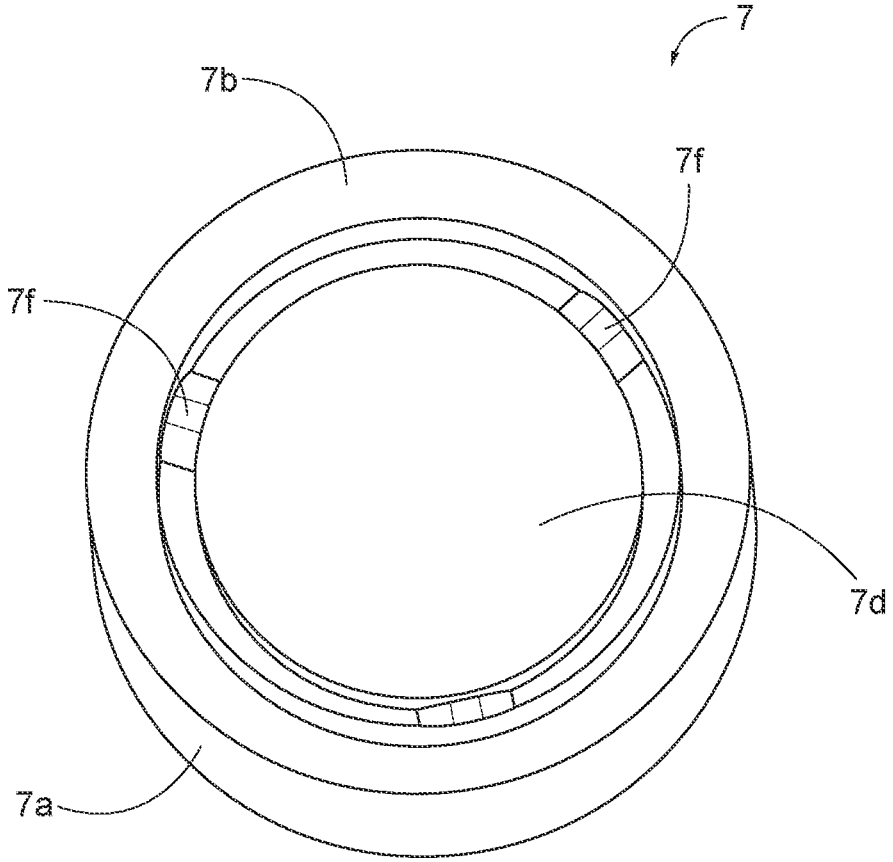
FIG. 13 is a top perspective view of the inner cap.
Figure 14:
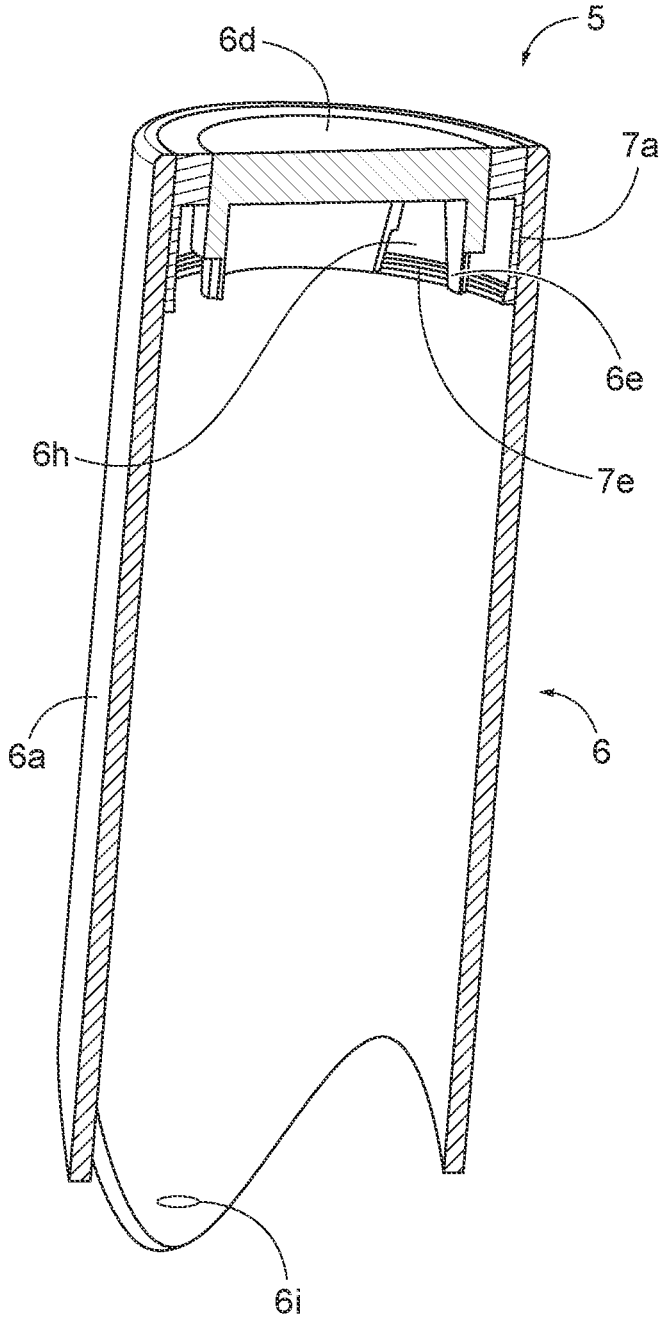
FIG. 14 is a cross sectional view that shows the relationship between the overshell and inner cap.

Like conventional overcaps, the overcaps of the present invention slide over the A-shells for the purpose of shielding the stick product from the ambient environment, as well as providing an aesthetically pleasing appearance. However, the overcaps of the present invention have several unique, functional features. FIGS. 11-15 show one embodiment of an overcap in greater detail. The overcap (5) comprises an overshell (6) and an inner cap (7). In FIGS. 11-13, the overshell and inner cap are shown as separate components. However, the best way to achieve the configuration described below, is by overmolding. For example, the overshell (6) is molded first, and then the inner cap (7) is molded into the overshell, making them effectively one component, as seen in FIG. 14. In the following discussion, only one of the overcaps is referenced, the other one being functionally identical.

1. Release Button

Conventional overcaps are usually held in place by a friction fit on the A-shell, and can be easily removed by holding the base of the lipstick, while pulling on the overcap. In contrast, in its closed configuration (FIG. 1), a dual-ended stick mechanism of the present invention presents a user with two overcaps (5, 5'). In use, one overcap is removed to expose one of the stick products, while the other overcap remains in place. Unless measures are taken, pulling the two caps apart is equally likely to remove either cap, maybe not the one that the user wanted to remove. As one unique feature of the present invention, each overcap is provided with a button that releases only the associated overcap from the rest of the mechanism.

The overshell (6) of the overcap (5) comprises a side wall (6*a*) with an opened top (6*b*) and an opened bottom (6*c*). The side wall is sized to fit over one of the A-shells (4), as in FIG. 2. The overshell further comprises a button (6*d*) suspended in the opened top of the side wall. Depending from the button is skirt wall (6*e*). The button and skirt wall are suspended in the opened top of the overshell by a number of flexible struts (6*f*) that extend between the skirt wall (6*e*) and the inner surface of the side wall (6*a*). Preferably, the side wall, button, skirt wall and struts are molded as one unit. The main purpose of the flexible struts is to suspend the button and skirt wall within the side wall of the overshell before the inner cap (7) is overmolded into the overshell.

Figure 15:
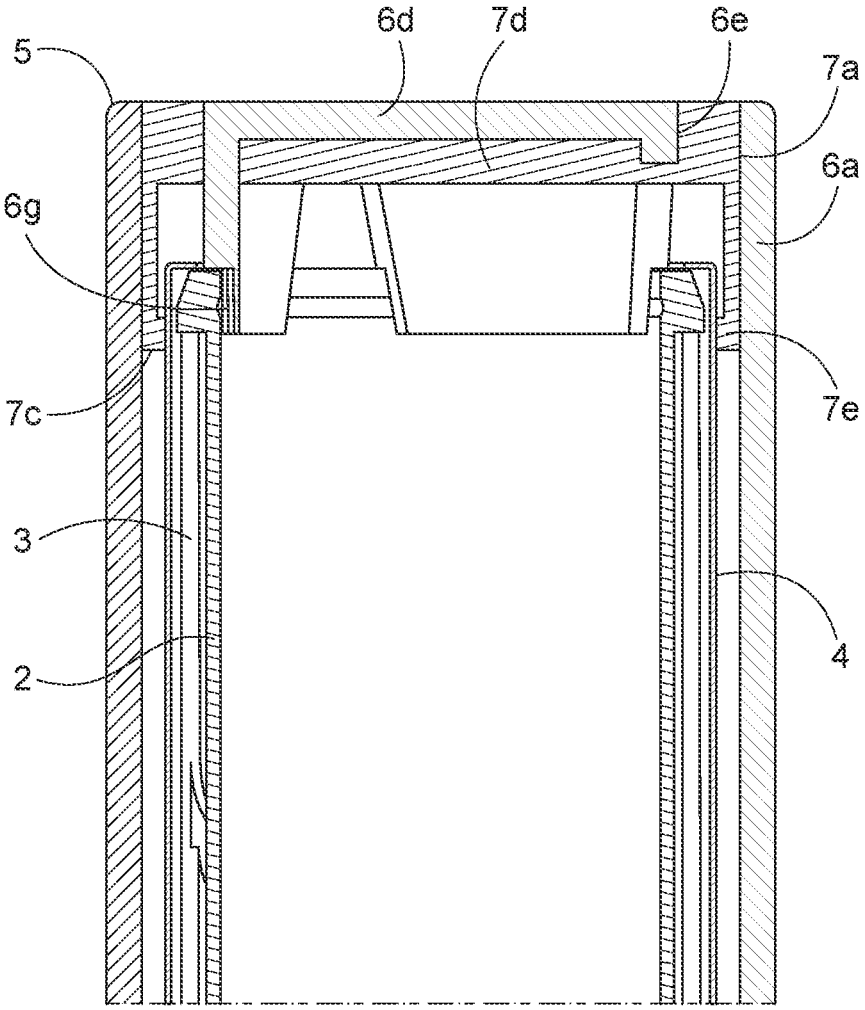
FIG. 15 is a cross sectional view that shows the relationship between the inner body, cam sleeve, A-shell, overshell and inner cap.

The inner cap (7) comprises a side wall (7*a*) with an opened top (7*b*) and an opened bottom (7*c*). The inner cap comprises a pressure surface (7*d*) that is suspended near the opened top of the inner cap by a number of flexible tabs (7*f*) that extend between the pressure surface and the inner surface of the side wall (7*a*). Referring to FIG. 15, the inner cap (7) is positioned inside the overshell (6), so that the side wall (7*a*) of the inner cap is sandwiched between the side wall (6*a*) and skirt wall (6*e*) of the button (6*d*). To accommodate the number of flexible tabs (7*f*) of the inner cap, the skirt wall of the button is provided with an equal number of cutouts (6*h*, see FIGS. 12, 14). Following the overmolding of the inner cap into the overshell (6), the pressure surface (7*d*) of the inner cap is positioned immediately under the button (6*d*). Thus, when a user presses the button (6*d*), both the button and pressure surface (7*d*) move downward (into the overshell), stretching the flexible tabs (7*f*).

When a fully assembled overcap (5) is positioned on an A-shell (4), the skirt wall (6*e*) of the button (6*d*) bears against the top of the inner body (2). Thus, when a user presses the top of the button (6*d*), the button applies pressure the inner body. This results in a longitudinal displacement of the inner body relative to the side wall (6*a*) of the overcap. In this way, the overcap is removed from the rest of the dual-ended mechanism, which is connected to the inner body, and there is no chance of removing the wrong overcap, as would be the case if a user merely pulled on both overcaps simultaneously. When user-applied pressure is released from the button, the flexible tabs (7*f*) are able to provide sufficient restoring force to return the button to its resting position.

2. Airtight Feature

As noted above, the inner cap (7) comprises a side wall (7*a*) with an opened top (7*b*) and an opened bottom (7*c*). When airtightness is a concern, then several raised rings (7*e*) may be positioned on the inner surface of the side wall, near the opened bottom end, The raised rings are of slightly smaller diameter than the outer diameter of the A-shell (4). When a fully assembled overcap (5) is positioned on an A-shell (4), the opened top (4*b*) of the A-shell slides into the opened bottom (7*c*) of the inner cap (7). Once the A-shell is inserted into the inner cap, the raised rings (7*e*), whose diameter is slightly smaller than the outer diameter of the A-shell, form an airtight seal between the inner cap and A-shell.

3. Connection Between Overcap and Inner Body

Now described, is a third unique feature of the overcaps (5, 5') of the present invention. In order to raise and lower the holder cup (1), a user must rotate one of the A-shells (4, 4') relative to the inner body (2). In a conventional mechanism, an external base is permanently connected to the inner body, so that rotation of the base relative to the A-shell will raise or lower the holder cup. However, the present invention has no base that is permanently attached to the inner body. Nevertheless, each overcap must be able to act as a base when it is mounted to its A-shell. Therefore, the skirt wall (6*e*) of the button (6*d*) is formed with a multiplicity of vertical grooves (6*g*) around its perimeter (see FIG. 12). When a first overcap (5) is positioned on a first A-shell (4), the skirt wall of the button extends into and through the opened top (4*b*) of the A-shell, and into the opened top (2*b*) of the inner body (2). This allows a connection to be established between the overcap and the inner body, so that those two components can rotate as one. This connection is shown in FIG. 15, where the teeth (2*g*) of the inner body are positioned in the vertical grooves (6*g*) of the button. This engagement is sufficient to prevent relative rotation between the overcap and inner body, so that when the overcap is rotated, so is the inner body. Because the grooves of the overshell are vertical, the teeth of the inner body will not prevent the overcap from being removed from its A-shell.

4. Locking Feature

Figure 16:
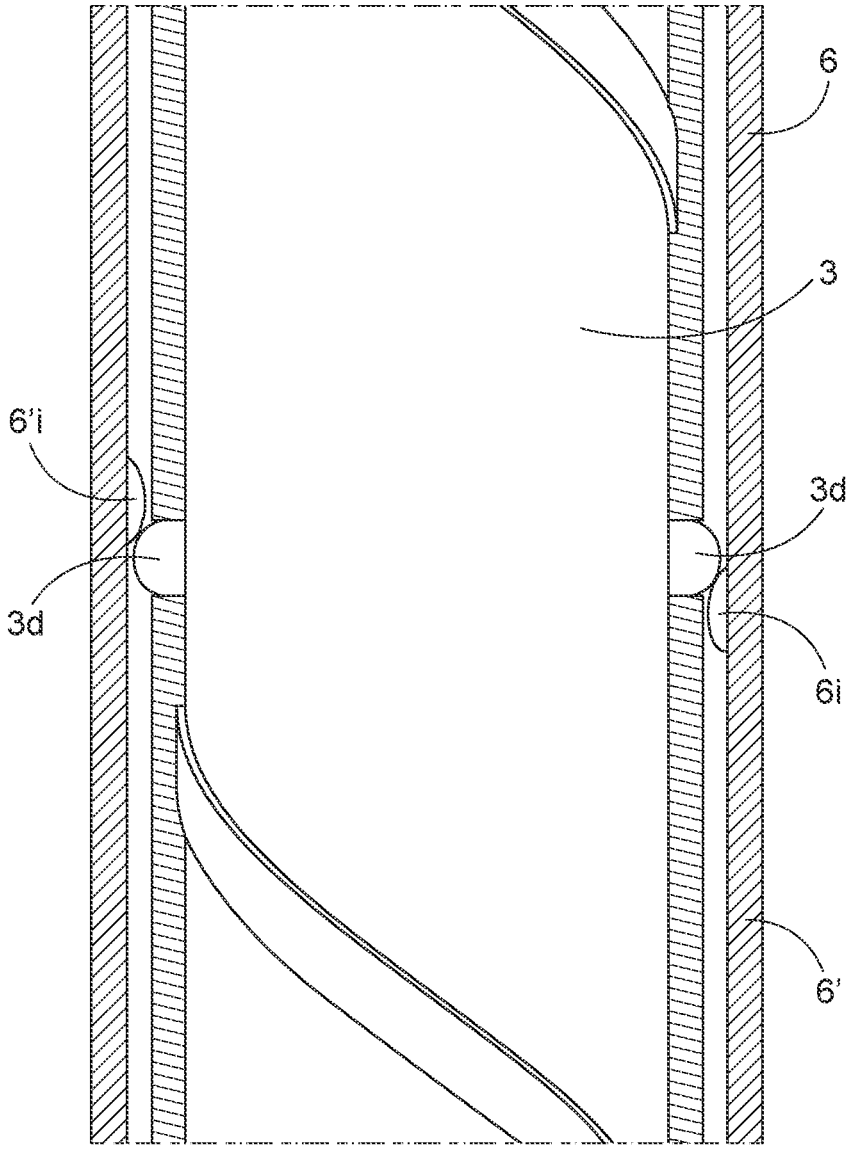
FIG. 16 is a cross sectional view that shows the locking feature of the inner body and the two overcaps.

Another unique feature of the present invention, each overcap is provided with a locking feature. One embodiment of two identical overcaps is shown in FIG. 1. In this embodiment, the two overcaps are complementary in the sense that they meet along a non-circular border, and each overcap extends beyond the midpoint of the dual-ended stick mechanism (10). For example, in the embodiment of FIGS. 11-14 and 16, the overshell (6) of each overcap (5) may be shaped such that a portion of the opened bottom (6*c*) of the overshell will extend over the annular stop (3*d*) of the cam sleeve (3, as seen in FIGS. 2 and 16). This lends some stability to the overcap as it sits on the A-shell (4). It also prevents the rotation of the two overcaps with respect to each other, which could place an undue amount of torque on the inner body, and possible other components. Optionally, each overshell (6, 6') may be provided with a set of one or more raised beads (6*i*, 6'*i*). Preferably, each set comprises at least two raised beads; more preferably at least three raised beads in each set. The first set of raised beads are positioned on that portion of the opened bottom of the first overshell that extends over and beyond the annular stop (3*d*) of the cam sleeve. The second set of raised beads are positioned on that portion of the opened bottom of the second overshell that extends over and beyond the annular stop (3*d*) of the cam sleeve. There is interference between the raised beads of either set and the annular stop. By "interference" I mean that when removing and replacing either overcap (5, 5'), the raised beads and annular stop must be forced under and over one another. In removing an overcap, the button feature described above is able to provide sufficient force to push the annular stop under the set of raised beads. In replacing the overcap, a user pushes the overcap onto the A-shell (4), again forcing the set of raised beads over the annular stop. With careful placement of the raised beads, the visible gap between the two overcaps can be zero every time the two overcaps are positioned on their respective A-shells. This further improves the overall airtightness and appearance of the mechanism.

Two Stick Products

The present invention offers two stick products (9, 9') in one dual-ended mechanism. The mechanism is useful for all types of stick products that are applied to a surface by drawing the product across the surface. For the purposes of the present invention, a stick product is an elongated mass of solid or semi-solid product that is able to support its own weight when the elongated mass is suspended by one end. A non-exhaustive list includes lipstick, lip gloss, lip balm, makeup sticks (foundation, concealer, blush, bronzer, etc.), deodorant sticks, anti-perspirant sticks, glue sticks, and many others. Preferably, the two products (9, 9') are complementary. For example, two shades of lipstick, or one lipstick and one lip gloss, or one foundation and one blush, or one deodorant and one solid perfume, or one adhesive and one primer to cure the adhesive, etc.

Assembly Method

A holder cup (2) is inserted into an inner body (2) by forcing the lug (1*e*) of the holder cup through the notch (2*d*), and into the upper segment (2*e*) of the longitudinal track of the inner body. Optionally, at this point the holder cup may be moved to the neutral position by sliding the lug of the holder cup between the bumps (2*h*, 2*h*') of the longitudinal track. Next, the cam sleeve (3) is mounted to the outside of the inner body by inserting the opened top (2*b*) of the inner body (the end with the notch (2*d*)) into the opened bottom (3*b*') of the cam sleeve. The notch will allow the side wall (2*a*) of the inner body to compress enough to allow the cam sleeve to slip onto the inner body. When fully seated on the inner body, the cam sleeve and the inner body are concentric, and the cam sleeve is trapped between the upper and lower rims (2*f*, 2*f*) that overhang the side wall (2*a*) of the inner body. The cam sleeve (3) fits over the inner body (2) in such a way that the distal end of the lug (1*e*) of the holder cup (1), which passes through the longitudinal track of the inner body, will be located in the helical groove (3*e*) of the cam sleeve.

First and second overcaps (5, 5') have previously been formed from first and second overshells (6, 6') and first and second inner caps (7, 7'), as explained above. The first overcap (5) is then fitted over the first A-shell (4), such that the skirt wall (6*e*) of the first button (6*d*) extends into and through the opened top (4*b*) of the first A-shell, and into the opened top (2*b*) of the inner body (2), where each of the first set of teeth (2*g*) of the inner body will come to rest in one of the vertical grooves (6*g*) of the first button. If not already done, the holder cup is moved its neutral position by positioning the relative rotation of the first overcap and the still exposed second A-shell, until the lug of the holder cup between the bumps (2*h*, 2*h*') of the longitudinal track. The second overcap (5') is then fitted over the second A-shell (4'), such that the skirt wall (6*e*') of the second button (6*d*') extends into and through the opened top (4*b*') of the first A-shell, and into the opened bottom (2*b*') of the inner body (2), where each of the second set of teeth (2*g*') of the inner body will come to rest in one of the vertical grooves (6*g*') of the second button. The assembly of the mechanism is now complete.

First and second stick products (9, 9') are formed first by any suitable method, such as hot pouring into a mold, then allowed to cool and solidify.

When it is desired to load a mechanism with two stick products, the first overcap (5) is removed and the dual-ended holder cup (1) is advanced to a fully extended position, away from the second overcap. The process for doing this is explained below. A first stick product is inserted into the upper reservoir (1*f*) of the holder cup. Next, the holder cup is lowered so that the first stick product is not protruding beyond the opened top (2*b*) of the inner body (2), and the first overcap is replaced. Then, the second overcap (5') is removed and the dual-ended holder cup (1) is advanced to a fully extended position, away from the first overcap. A second stick product is inserted into the lower reservoir (1*f*')

of the holder cup. Next, the holder cup is lowered so that the second stick product is not protruding beyond the opened bottom (2*b*') of the inner body (2). Preferably, the holder cup is moved its neutral position by positioning the lug (1*e*) of the holder cup between the bumps (2*h*, 2*h*') of the longitudinal track. Finally, the second overcap is replaced.

Use

When it is desired to use one of the stick products (9, for example), a user presses the button (6*d*) of overcap (5). She may do this by wrapping here fingers around the side wall (6*a*) of the overshell and using a thumb to depress the button. This displaces the rest of the dual-ended mechanism longitudinally, relative to the overcap, and it forces the annular stop (3*d*) of the cam sleeve (3) under the raised beads (6*i*) of the overcap. In so doing, the overcap (5) is easily removed from the A-shell (4), and the rest of the mechanism is received into the user's other hand. Next, the user grips the exposed A-shell (4) in one hand and the overcap (5') that is still attached in the other hand. The user rotates the A-shell (for example, counterclockwise) relative to the overcap and inner body (2). This forces the lug (1*e*) of the holder cup (1) over one of the bumps (2*h*) of the inner body, and then continues to raise the holder cup with the lug travelling along either the upper segment (2*e*) of the longitudinal track until it enters the horizontal track (2*c*) of the inner body, at which time the stick product (9) is fully extended out of the mechanism (10) for its intended use.

When the user is finished with the stick product (9), she again grips the exposed A-shell (4) in one hand and the overcap (5') that is still attached, in the other hand. The user rotates the A-shell (for example, clockwise) relative to the overcap. This lowers the holder cup (2), and the stick product (9) is retracted into the mechanism. The user continues to rotate the A-shell until the lug (1*e*) of the holder cup is forced over the first bump (2*h*) of the inner body, at which time the holder cup will be located in its neutral position, and she stops rotating. The overcap (5) which was removed, is replaced on the exposed A-shell (4), again forcing the raised beads (6*i*) of the overcap over the annular stop (3*d*) of the cam sleeve (3). If desired, the same procedure can be repeated on the other side of the mechanism (10) to use the other stick product.

What is claimed is:

1. A dual-ended stick mechanism comprising:

an inner body that comprises:

a cylindrical side wall that has an opened top and an opened bottom;

a longitudinal track that passes through the side wall; and a first set of teeth that project inward, equally spaced around the perimeter of the opened top of the inner body;

a second set of teeth that project inward, equally spaced around the perimeter of the opened bottom of the inner body;

a holder cup that travels within the inner body, and comprises:

a cylindrical wall that defines a reservoir, and a lug that extends perpendicularly from the cylindrical wall, wherein:

the lug is long enough to extend through the longitudinal track of the inner body; and the reservoir is able to hold two stick products that extend from the holder cup in opposite directions;

a cam sleeve that comprises:

a hollow cylindrical body that has an opened top, an opened bottom, a midpoint and an interior surface;

the interior surface having a helical groove that starts near the opened top of the hollow cylindrical body, and completes from 1 to 3 revolutions to end near the opened bottom of the hollow cylindrical body; wherein the cam sleeve is mounted to the outside of the inner body such that the lug of the holder cup is located in the helical groove;

a first A-shell that comprises a cylindrical side wall, an opened upper end and an opened lower end, wherein the opened lower end of the first A-shell fits over the opened top of the cam sleeve, wherein the first A-shell and cam sleeve rotate as one;

a second A-shell that comprises a cylindrical side wall, an opened upper end, and an opened lower end, wherein the opened lower end of the second A-shell fits over the opened bottom of the cam sleeve, wherein the second A-shell and cam sleeve rotate as one;

a first overcap comprising:

a cylindrical side wall with an opened bottom that slides over the opened top of the first A-shell;

a first button that has a multiplicity of vertical grooves that extend into the opened top of the inner body, such that the first set of teeth of the inner body are positioned in the vertical grooves of the first button;

wherein, pressing the first button results in a longitudinal displacement of the inner body relative to the cylindrical side wall of the overcap; and a second overcap comprising:

a cylindrical side wall with an opened bottom that slides over the opened top of the second A-shell;

a second button that has a multiplicity of vertical grooves that extend into the opened bottom of the inner body, such that the second set of teeth of the inner body are positioned in the vertical grooves of the second button;

wherein, pressing the second button results in a longitudinal displacement of the inner body relative to the cylindrical side wall of the overcap.

2. The dual-ended stick mechanism of claim 1 wherein the inner body further comprises:

an upper horizontal track and a lower horizontal track that extend from the longitudinal track, wherein at least one of the upper and lower horizontal tracks intersects with a notch that opens up onto the opened top or opened bottom of the inner body.

3. The dual-ended stick mechanism of claim 1 wherein the inner body further comprises:

two bumps that are located a short distance above and below the midpoint of the longitudinal track, the bumps projecting into the longitudinal track to offer resistance to the movement of the holder cup.

4. The dual-ended stick mechanism of claim 1 wherein the opened top of the inner body is formed with an upper rim, and the opened bottom of the inner body is formed with a lower rim, such that both rims overhang the side wall of the inner body, and the cam sleeve is trapped between the upper and lower rims.

5. The dual-ended stick mechanism of claim 1 wherein the first overcap has raised rings that grip the first A-shell to form an airtight seal, and the second overcap has raised rings that grip the second A-shell to form an airtight seal.

6. The dual-ended stick mechanism of claim 1 wherein the helical groove completes 1, 1¼, 1½, 1¾, 2, 2¼, 2½, 2¾ or 3 revolutions.

7. The dual-ended stick mechanism of claim 1 wherein:

the cam sleeve further comprises an exterior surface that has an annular stop located at the midpoint of the cam sleeve; and the first and second A-shells bottom out on the annular stop.

8. The dual-ended stick mechanism of claim 7 wherein the first overcap and second overcap meet along a non-circular border.

9. The dual-ended stick mechanism of claim 8 wherein:

a portion of the opened bottom of the first overcap, and a portion of the opened bottom of the second overcap extend over and beyond the annular stop of the cam sleeve.

10. The dual-ended stick mechanism of claim 9 wherein:

a first set of one or more raised beads are positioned on that portion of the opened bottom of the first overcap that extends over and beyond the annular stop of the cam sleeve;

a second set of one or more raised beads are positioned on that portion of the opened bottom of the second overcap that extends over and beyond the annular stop of the cam sleeve; such that:

there is interference between the first set of raised beads and the annular stop, and between the second set of raised beads and the annular stop.

11. The dual-ended stick mechanism of claim 1 wherein the holder cup further comprises one or more vent holes that pass through the cylindrical wall of the holder cup.

12. The dual-ended stick mechanism of claim 1 wherein:

the reservoir of the holder cup is divided into an upper reservoir and a lower reservoir by a partition, and each reservoir is able to receive and retain a portion of a stick product.

* * * * *